US006527143B1

(12) United States Patent
Schomäcker

(10) Patent No.: US 6,527,143 B1
(45) Date of Patent: Mar. 4, 2003

(54) HOT MELT APPLICATOR

(75) Inventor: Andre Schomäcker, Harsewinkel (DE)

(73) Assignee: Steinel GmbH & Co. KG, Herzebrock-Clarholz (DE)

( * ) Notice: Subject to any disclaimer, the term of this patent is extended or adjusted under 35 U.S.C. 154(b) by 0 days.

(21) Appl. No.: 09/914,438

(22) PCT Filed: Mar. 6, 2000

(86) PCT No.: PCT/EP00/01871

§ 371 (c)(1),
(2), (4) Date: Dec. 26, 2001

(87) PCT Pub. No.: WO00/53338

PCT Pub. Date: Sep. 14, 2000

(30) Foreign Application Priority Data

Mar. 5, 1999 (DE) ..... 199 09 641

(51) Int. Cl.[7] ..... B67D 5/62
(52) U.S. Cl. ..... 222/146.5
(58) Field of Search ..... 222/146.1, 146.2, 222/146.5

(56) References Cited

U.S. PATENT DOCUMENTS 3,204,828 A * 9/1965 Paulsen ..... 222/146.5
3,612,357 A * 10/1971 Ruskin ..... 222/146.2
3,743,142 A * 7/1973 Elliott et al. ..... 222/146.5
4,493,972 A * 1/1985 Steinel et al. ..... 222/146.5
4,692,587 A 9/1987 Spirk, Jr. et al.
4,826,049 A * 5/1989 Speer ..... 222/146.5
5,688,421 A * 11/1997 Walton ..... 222/146.5

FOREIGN PATENT DOCUMENTS

| | | |
|---|---|---|
| DE | 33 16 863 | 11/1984 |
| EP | 0 385 235 | 9/1990 |
| WO | WO 89/10324 | 11/1989 |

* cited by examiner

*Primary Examiner*—Henry C. Yuen
*Assistant Examiner*—Stephanie Willatt
(74) *Attorney, Agent, or Firm*—Bachman & LaPointe, P.C.

(57) ABSTRACT

The invention relates to a hot-melt adhesive applicator having a manually handleable applicator unit which is adapted to electrically heat a replaceably insertable adhesive container, in particular for adhesive which can be liquefied by the action of heat, and which has a heating unit of a material of a predetermined heat capacity and which is provided for transferring heat to the adhesive container and which affords a contact surface for the heat transfer and which has an electrical heating element, and a support module which is adapted to act on the heating element with an electrical voltage in a fitted holding condition of the applicator unit, the support module being so designed that the heating element is supplied with voltage only in the holding condition and the supply of voltage to the heating element cannot occur when the applicator unit is in an adhesive application condition of being detached from the support module.

12 Claims, 2 Drawing Sheets

HOT MELT APPLICATOR

BACKGROUND OF THE INVENTION

The present invention concerns a hot-melt adhesive applicator, in particular a hot-melt adhesive applicator in gun form. Devices of that kind with mains voltage-operated heating units in a manually actuable gun housing provided with an advance unit for solid adhesive bars to be heated (therefore often also referred to as a 'heating adhesive applicator') have long been known from the state of the art, but they suffer from a series of disadvantages: thus the voltage connection which is permanently necessary, for example by means of a mains cable, gives rise to difficulty in terms of free handling of the adhesive gun, conventional adhesives to be melted in solid bar form are limited in respect of their range of uses, and in particular simultaneous heating of the adhesive which is to be caused to melt for use thereof is often inadequate, by virtue of the structural implementations of the known heating device.

A hot-melt adhesive applicator is known from WO 89/10324.

In addition EP 0 385 235 A1 describes a hot-melt adhesive applicator in the form of a hot-melt adhesive applicator which is designed in the shape of a gun and which, for heating a hot-melt adhesive bar, has a plurality of separately operable heating elements in the form of PCT resistors, operation of the heating elements being effected in dependence on a temperature regulating circuit. A plurality of heating elements are also described in the hot-melt adhesive applicator known from DE 33 16 863 A1, in which case also an adhesive bar, under suitable actuation, can be liquefied.

Therefore the object of the present invention is to make a known hot-melt adhesive applicator more flexible in terms of its handling and use options, and in particular also to make it suitable for adhesives of the most widely varying kinds and with varying melting properties, and in addition to improve the electrical safety of known devices.

SUMMARY OF THE INVENTION

The foregoing object is attained by the hot-melt adhesive applicator comprising a hot-melt adhesive applicator comprising a manually handleable applicator unit which is adapted for electrically heating a replaceably insertable adhesive container, in particular for adhesive which can be liquefied by the action of heat, and which has a heating unit comprising a material of a predetermined heat capacity, which is provided for the transfer of heat to the adhesive container and which affords a contact surface for heat transfer and which has an electrical heating element, and a support module which is adapted to act on the heating element with an electrical voltage in a fitted holding condition of the applicator unit and which is so designed that the heating element can be supplied with voltage only in the holding condition and not in an operative adhesive application condition of the applicator unit of being detached from the support module. The method of the present invention comprises the steps of claim 9.

Thus, in an advantageous manner in accordance with the invention, the applicator unit which can be detached from the support module permits completely cable-free or connection-free handling of the heating module which is preferably provided with a pistol-like grip, so that not only is it possible to reach locations which involve a difficult access, but it is also possible to avoid potential risks arising due to the presence of an electrical power supply cable at the location of use.

The fact that the handle or grip unit is releasable in a further development of the invention also permits easy replacement of consumed adhesive containers which in a further preferred feature can be present in cartridge form and, by virtue of the structural configuration of the heating unit, in the form of a profile member, can be provided with optimised efficient input of heat. The coding of adhesive cartridges and heating module, which is provided in accordance with a development of the invention, permits in a particularly advantageous manner a further enhancement in the flexibility of the options of use involved, by virtue of a specific design configuration or setting of heating modules for specific adhesives, in particular in regard to any, especially required melting and operating temperatures, without the possibility of incorrect associations in practical alternate operation.

The temperature switch which is provided in accordance with a further developments permit activation or deactivation of the heating unit in dependence on an actual (observed) temperature so that by specifically and targetedly switching on additional heating power at measured temperatures below an operating temperature it is possible to minimise detrimental delays due to long heating times.

The brightness control unit which is provided in accordance with a development of the invention also eliminates the disadvantageous consequences of devices which are kept in a heating mode of operation over a long period of time (that is to say for example overnight), both in regard to a worsening quality of adhesive and also in terms of electrical power consumption.

BRIEF DESCRIPTION OF THE DRAWINGS

Further advantages, features and details of the invention will be apparent from the following description of preferred embodiments and with reference to the Figures in which:

FIG. 1 is an exploded view showing the mechanical structural configuration of the hot-melt adhesive applicator according to the invention in accordance with a first preferred embodiment.

DETAILED DESCRIPTION

Figure 1:
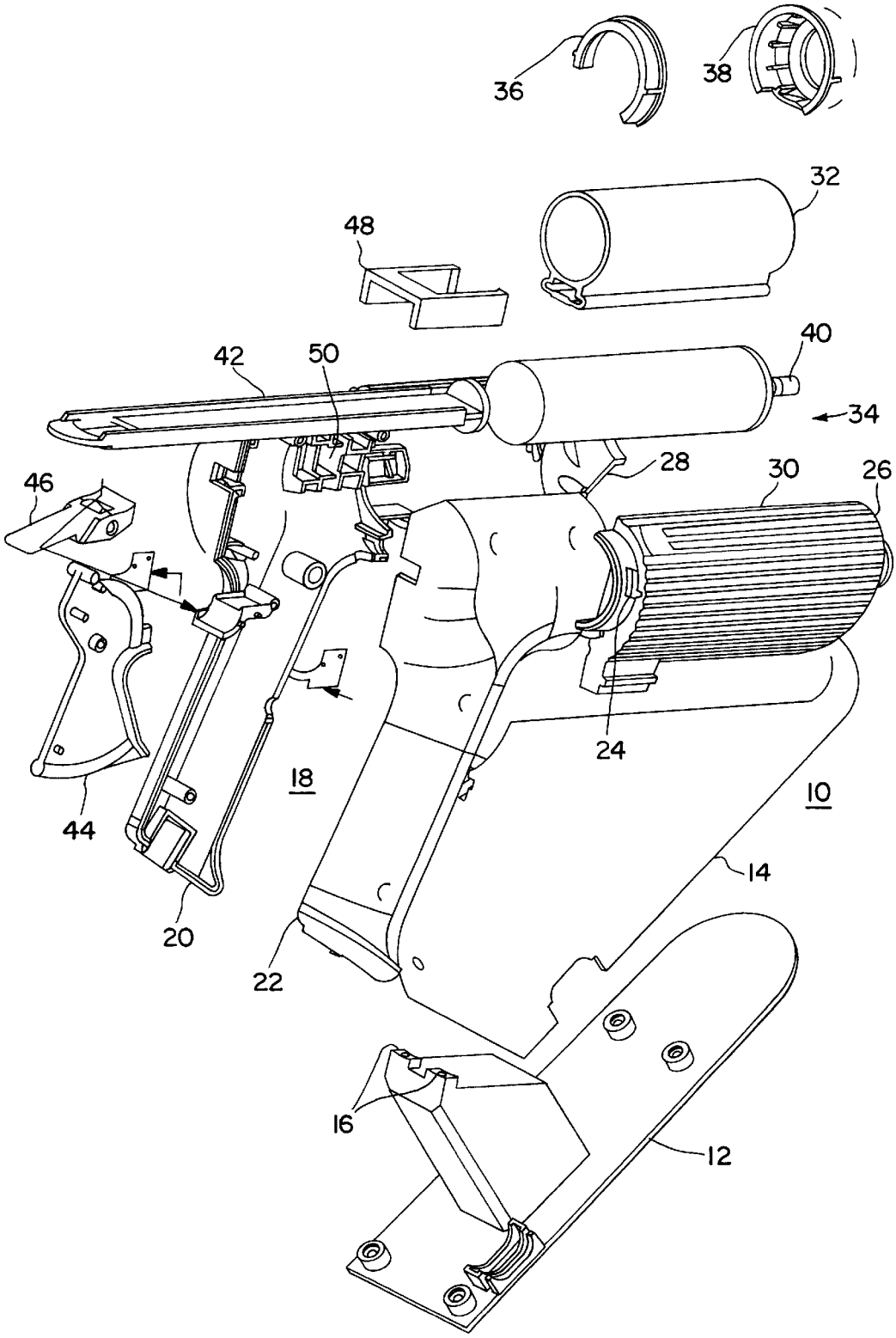
FIG. 1 is an exploded view of the present hot-melt adhesive applicator in accordance with a first preferred embodiment with the essential mechanical components and the co-operation thereof with each other in the assembled condition.

A support unit 10 comprising a support bottom plate 12 and a support housing 14 has a mains feed line (not shown) and connecting electronics which by means of a pair of contacts 16 provides operating voltage for a gun-shaped applicator or adhesive unit 18.

Figure 2:
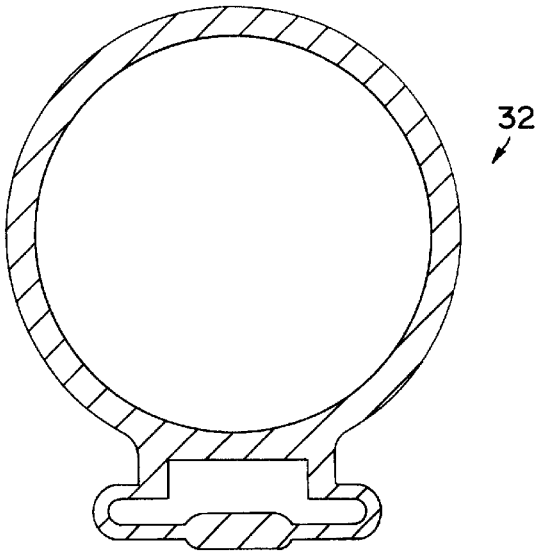
FIG. 2 shows a profile view of the heating unit in the form of a metal profile member of the embodiment of FIG. 1.

The adhesive unit 18 is formed on the one hand from a grip or handle which is made from grip casing portions 20, 22 and which can be releasably connected by means of a bayonet locking unit 24 (20, 24 constituting a grip unit) to a heating housing 26 comprising housing shell portions 28, 30. The heating housing 26 encloses a heating profile member formed from aluminum (FIGS. 2 through 4) of a length 1 of about 80 mm, which affords a cylindrical internal space for accommodating a cylindrical adhesive container 34, for example with liquid adhesive or adhesive which can be liquefied by virtue of the external effect of heat, and which accommodates additional PTC heating elements.

The arrangement consisting of the heating profile member 32 and the cartridge 34 is fixed in the heating housing 26 by means of rear (36) and front (38) holding rings made from heat-resistant plastic material, wherein the cartridge 34 is exposed at its exit end and has an outlet 40.

Discharge of adhesive material which has been heated by means of the heating profile member 32 from the cartridge is effected by the pressure action of an advance bar 42 which can be moved in the axial direction of the cartridge 34 by an advance unit formed by an advance lever 34 and an advance hook 46, engaging a tooth arrangement of the advance bar which is in the form of a toothed rack, as soon as an operator using his index finger actuates the advance lever 44 in the fashion of a gun trigger. A braking element 48 in the form of a clip prevents the advance bar 42 from moving out of the assembly in the opposite direction to the pressing direction.

Provided in the left-hand grip or housing shell portion 20 there is also an accommodating space 50 for a thermal or bimetal switch (not shown) which in the assembled condition contacts the heating profile portion 32 at the periphery thereof and thus permits temperature measurement; that electrical unit produces a control signal which controls the heating operation of the arrangement in the manner to be described hereinafter.

Figure 3:
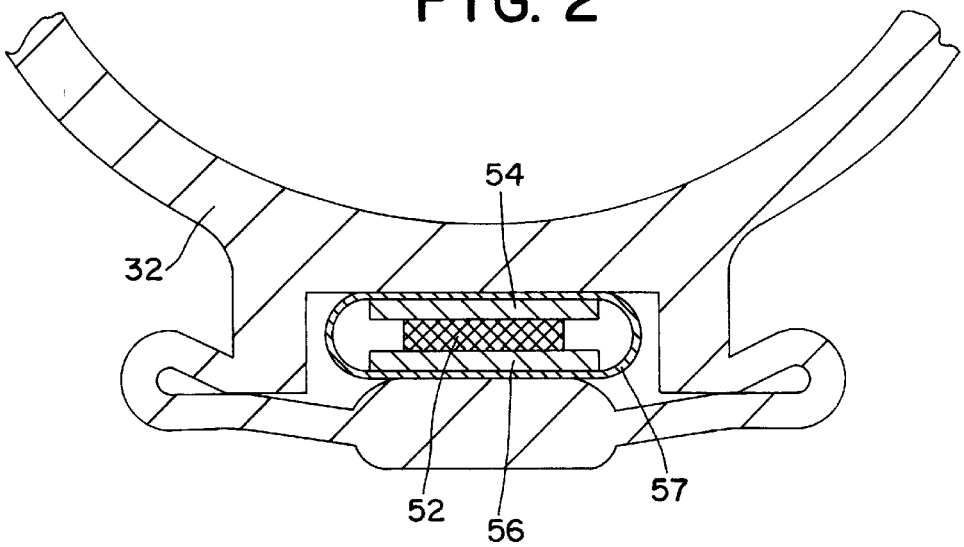
FIG. 3 shows a detail view of the heating unit of FIG. 2.
Figure 4:
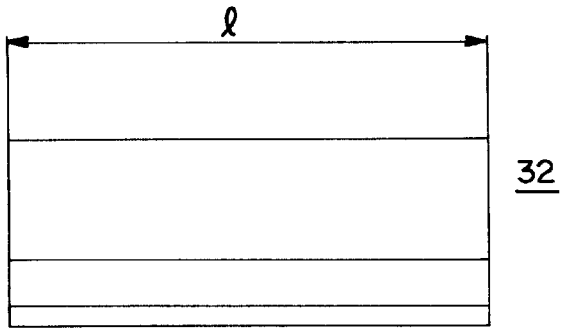
FIG. 4 shows a side view of the heating unit of FIGS. 2 and 3.

As indicated in the enlarged view of a part of the arrangement as shown in FIG. 3 the heating profile member in the cross-sectional direction has a chamber portion adapted for the insertion of two PTC heating elements together with contacting means. To put that more precisely, a first PTC 52 is so held in the accommodating space as shown in FIG. 3 that it can be acted upon with electrical voltage through contacts engaging at the end a first conductor segment 54 and a second common conductor segment 56. The arrangement is surrounded by an electrically insulating sheath 57. In the axial direction of the heating profile member a second PTC (not shown) is disposed in aligned adjacent relationship with the first one and is contacted with the common second conductor segment 56 at which for example common neutral conductor potential is applied. In contrast the first conductor segment 54 (phase) is separated for the first PTC (shown in the Figure) and the second PTC (not shown) so that in that respect it is possible to provide for a contacting action which is separate (each respectively engaging an end position). That takes place as follows: the first PTC is adapted for ongoing heating operation and with a heating temperature of about 170° C. permits continuous heating of the heating profile member to a constant temperature of between about 130 and approximately 140° C., which in the present embodiment is selected as the operating adhesion temperature for the adhesive in the adhesive cartridge 34. The second PTC is only provided for heating-up purposes, it has a higher heating temperature of for example 300° C. and is only activated if the temperature of the heating unit 32, which is detected by means of the thermoelement in the accommodating space 50, is below the reference operating temperature of between 130 and 140° C. In that case, a troublesome waiting time until the operating temperature is regained can be shortened by the high power which is applied for a short period of time. In addition a red or green LED 58, 60 display those operating conditions (that is to say current operating temperature below reference operating temperature or at same) in such a fashion that the situation is optically visible to the user.

In practical operation therefore the user will leave the adhesive applicator unit 18 in the support until, after the arrangement is electrically switched on, the reference temperature is reached (which is attained after a heating time which is shortened in comparison with the state of the art, by virtue of the additional powerful PTC), whereupon then the applicator unit 18 can be removed and adhesive can be discharged therefrom at the location of use by actuation of the lever 44. After use, the applicator unit 18 is returned to the support again and, if the current temperature of the adhesive in the cartridge has fallen below a predetermined limit value, the additional PTC is activated again to provide an accelerated heating effect.

An embodiment which is particularly useful in practical use is one in which it is possible to provide for individualisation and replaceability of the heating device for various adhesives and cartridges, by means of suitable coloration of the heating housing 26 (for example coloring of the housing shell portions 28, 30), with a color which is characteristic of a specific adhesive in the cartridge 34: thus for example for given adhesives which require a specific temperature operating range, a heating profile member 32 which is especially designed for that purpose can be accommodated in a housing which is characteristically coded in color and which in terms of its coloration corresponds to the cartridge with that adhesive so that there is no possibility of improper associations therebetween. The operator can adapt and replace a respective color cartridge and associated heating housing for various adhesive application uses.

What is claimed is:

1. A hot-melt adhesive applicator comprising:

an applicator unit including a heating unit for receiving a replacably insertable adhesive container, said heating unit being formed of a material for transferring heat to the adhesive container, said heating unit comprises a one-piece metal profile element which has a first space for accommodating the adhesive container and an additional space for receiving an electrical heating element means; and a support module including means for removably connecting the applicator unit, said support module further including means for selectively applying an electrical voltage to the heating element wherein the heating element means is supplied with electrical voltage when the applicator unit is connected to the support module and not supplied when detached therefrom.

2. An applicator according to claim 1, wherein the applicator unit comprises a grip unit which is releasably connected to a heating module by connecting means.

3. An applicator according to claim 2, wherein the connecting means comprises a bayonet locking arrangement.

4. An applicator according to claim 2, wherein the grip unit includes an actuable expulsion and metering unit for expelling adhesive from the adhesive container.

5. An applicator according to claim 1, wherein the electrical heating element means comprises a plurality of independently operated heating elements each having different electrical heating outputs.

6. An applicator according to claim 1, wherein the heating unit includes means for displacing temperature.

7. An applicator according to claim 1, further including an ambient brightness detection unit for deactivating the heating element means in response to ambient brightness.

8. An applicator according to claim 1, wherein the adhesive container is coded for each adhesive contained therein.

9. A method for operating a hot-melt adhesive applicator having a plurality of heating elements for heating a heating module containing an adhesive container, comprising the steps of:

electrically operating plurality of electrical heating elements of the heating module to electrically heat the adhesive container;

partially deactivating operation of the electrical heating elements by selective operation of the plurality of electrical heating elements, wherein a detected operating temperature of the adhesive container exceeds a first predetermined threshold value; and renewed activation of the electrical operation of the plurality of heating elements as soon as the detected temperature falls below a predetermined second threshold value which is lower than the first threshold value.

10. A method according to claim 9 further comprising the step of:

optically displaying the detected temperature and the operational condition of the plurality of electrical heating elements.

11. A method according to claim 9 further comprising the step of:

deactivating the electrical heating elements when the level of ambient light falls below a predetermined level of light corresponding to an ambient dark condition.

12. A method according to claim 9 further in comprising the steps of:

fitting the heating module on to a support module for providing electrical power for the heating elements and rapidly heating the heating elements at the maximum available heating output until a reference temperature is reached, and thereafter switching over to a holding temperature with a reduced heating output.

* * * * *